United States Patent [19]

Pertramer

[11] Patent Number: 4,740,182

[45] Date of Patent: Apr. 26, 1988

[54] MAST BASE ARRANGEMENT FOR A SURFBOARD

[76] Inventor: Siegfried Pertramer, Ferdinand-Miller-Str. 11, 8080 Fürstenfeldbruck, Fed. Rep. of Germany

[21] Appl. No.: 774,181

[22] Filed: Sep. 9, 1985

Related U.S. Application Data

[63] Continuation of Ser. No. 568,163, Jan. 4, 1984, abandoned.

[30] Foreign Application Priority Data

Jan. 4, 1983 [DE] Fed. Rep. of Germany ..... 3300117
Aug. 11, 1983 [DE] Fed. Rep. of Germany ..... 3333352

[51] Int. Cl.[4] ..... B63B 35/72
[52] U.S. Cl. ..... 441/74; 114/90
[58] Field of Search ..... 441/65, 74; 114/89, 114/90, 93

[56] References Cited

U.S. PATENT DOCUMENTS

| | | | |
|---|---|---|---|
| 4,073,254 | 2/1978 | Marker | 114/90 |
| 4,166,425 | 9/1979 | Kummetz | 114/90 |
| 4,236,476 | 12/1980 | Souf | 441/74 |
| 4,421,491 | 12/1983 | Pleass | 114/90 |
| 4,455,959 | 6/1984 | Suzuki | 114/90 |
| 4,466,375 | 7/1984 | Marker | 441/74 |
| 4,530,299 | 7/1985 | Ross | 441/74 |

FOREIGN PATENT DOCUMENTS

| | | | |
|---|---|---|---|
| 0054241 | 12/1981 | European Pat. Off. | 114/93 |
| 2700446 | 7/1978 | Fed. Rep. of Germany | 114/93 |
| 2702608 | 7/1978 | Fed. Rep. of Germany | 114/93 |
| 2489237 | 3/1982 | France | 114/93 |
| 0142199 | 5/1985 | France | 114/90 |
| 8105110 | 6/1983 | Netherlands | 114/90 |

*Primary Examiner*—Joseph F. Peters, Jr.
*Assistant Examiner*—Clifford T. Bartz
*Attorney, Agent, or Firm*—Armstrong, Nikaido, Marmelstein & Kubovcik

[57] ABSTRACT

In a mast base arrangement for a surfboard having a mast base lower part which is disposed beneath a universal joint (5) and which engages in an opening of a connecting member on the surfboard side, the mast base lower part is provided with a lever (59) in order to facilitate the insertion of the mast base lower part into the opening of the connecting member.

12 Claims, 2 Drawing Sheets

MAST BASE ARRANGEMENT FOR A SURFBOARD

This application is a continuation of application Ser. No. 568,163 filed Jan. 4, 1984 now abandoned.

The invention relates to a mast base arrangement for a surfboard in which for establishing the connection between mast and surfboard beneath a mast base lower part carrying a universal joint a connecting member is provided which is constructed in particular as displaceable slide, the connecting member having at the upper side an opening into which the correspondingly shaped mast base lower part is insertable.

In particular in the case where the connecting member is constructed as displaceable slide, which makes it possible during the sailing to vary the point of application of the force applied by the sail mast to the surfboard, for constructional reasons the axial length of the mast base lower part is made exceedingly short, i.e. of the order of magnitude of a few centimeters. In particular, with cetain slides an axial length of the mast base lower part of at the most about 2.5 cm is possible.

With such a short mast base lower part the latter is no longer sufficient as lever to enable for example on the water the mast base lower part to be inserted into the opening again because for this purpose to bend the mast base lower part relatively to the mast the spring forces of the universal joint usually constructed as rubber block must be overcome. For in this case the return forces caused by the rubber joint must be overcome for insertion of the mast base lower part into the opening of the slide because for example when the rig lies flat on the water to insert the mast base lower part the latter must be bent by more than 90° with respect to the mast.

The problem underlying the invention is therefore to provide an arrangement which permits and facilitates the insertion of the mast base lower part into the opening of the connecting member also in such cases in which the mast is in a pronounced angled position with respect to the axis of the opening of the connecting member, i.e. substantially with respect to the vertical to the surfboard.

This problem is solved according to the invention in that the mast base lower part is connected to a lever which extends substantially in radial direction with respect to the longitudinal axis of the connecting member or of the universal joint. By means of such a lever the rubber joint can easily be correspondingly bent by hand for insertion of the mast base lower part.

Further advantageous features of the invention will be apparent from the subsidiary claims. Hereinafter an example of embodiment of the invention will be described in detail with the aid of the drawings, wherein:

Figure 1:
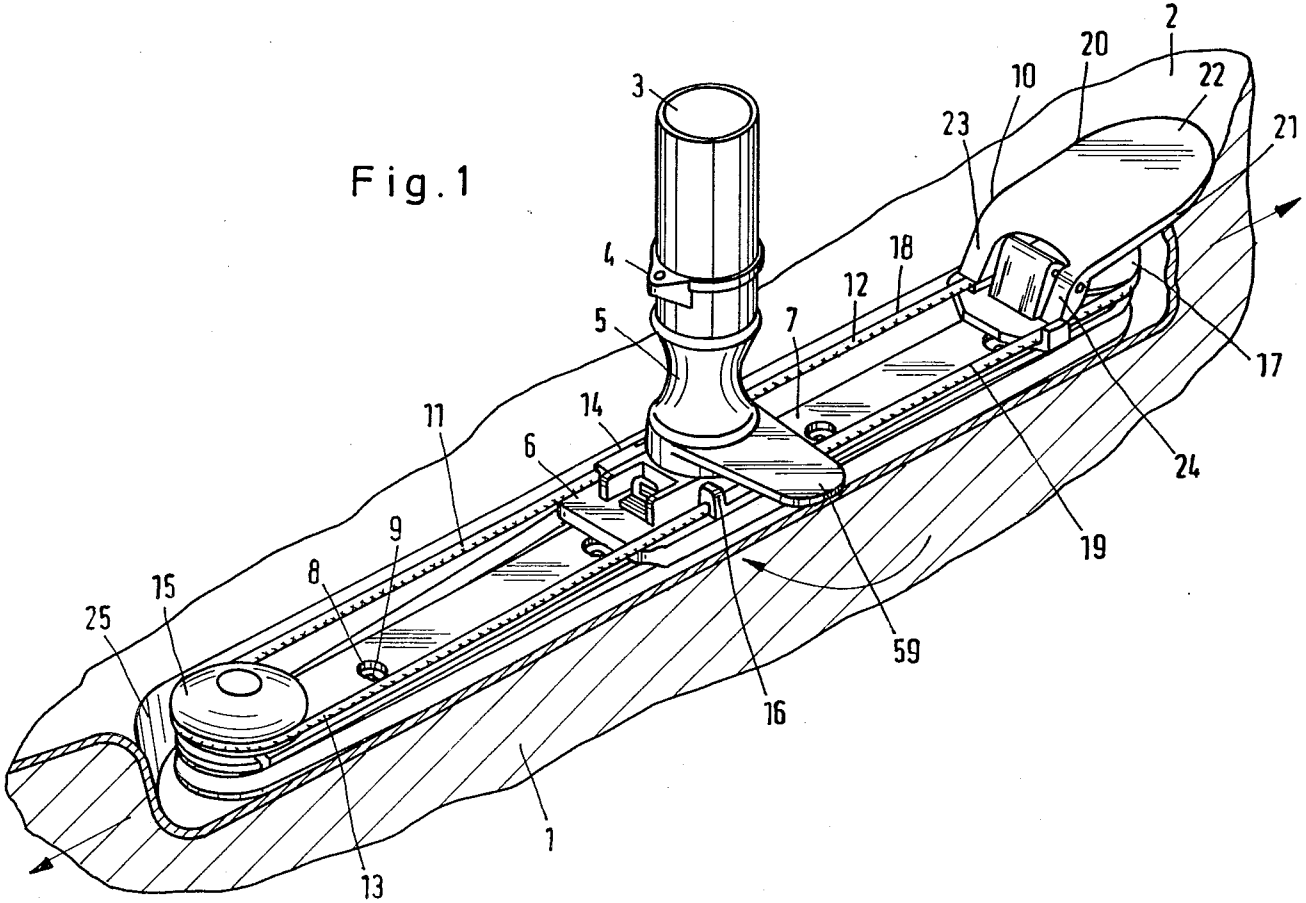
FIG. 1 is a schematic perspective view of the mast base arrangement.

FIG. 1 shows a fragment of a surfboard 1 on the top surface 2 of which a rig not illustrated in detail is mounted displaceably in the longitudinal direction of the surfboard 1 by means of a mast base arrangement. The rig itself is carried by the mast socket or sleeve 3 onto which the lower end of the usually hollow mast is fitted and connected to said mast sleeve 3 by tightening that luff cord, not illustrated, of the sail against an eye 4 on the mast sleeve. As usual the mast sleeve 3 forms the mast base upper part.

Beneath the mast base upper part 3 a universal joint 5 is provided which is formed by a rubber member or silent block which is connected with the individual parts of the mast base for example by screw means. The universal joint 5 is connected to a mast base lower part which is releasably insertable into a slide 6 in the manner of a safety binding.

As illustrated in FIG. 1 the slide 6 is displaceable in secured manner along a rail 7 which is connected to the surfboard 1 for example by means of screws 9 accommodated by bores 8 in the rail. The slide 6 can be locked in any desired position by a coupling means denoted generally by 10. The coupling means 10 is located at the rear end of the rail 7 and acts on a connecting means which is connected to the slide 6 and by the remote action of which the slide is fixed in the particular position desired.

The connecting means denoted generally by 11 is constructed as chain or belt-type drive and in particular as cord or rope drive 12. The rope drive 12 is formed in that one end of a rope 13 proceeding from a fastening means 14 on the slide 6 is placed round a guide pulley 15 rotatably mounted in the region of the front end of the rail 7. The rope 13 then leads rearwardly, a further holding means or guide 16 being advantageously provided in the slide itself through which the rope 13 is additionally guided, to a further rear guide pulley 17 disposed behind the coupling means 10. From the guide pulley 17 the rope 13 is led forwardly again to the fastening means 14 on the slide 6. The fastening means 14 secures both free ends of the rope 13. In this manner an endless loop of the rope 13 is established in the form of a chain or belt-type drive which at one point, i.e. at the fastening means 14, is fixedly connected to the slide 6. If therefore the slide 6 is moved forwards or rearwards along the rail 7 the runs 18, 19 of the rope drive move accordingly in opposite direction to each other, the rope 13 being able to slide freely through the guide 16 on the slide 6, and because of the rotatable mounting of the guide pulleys 15 and 17 preferably constructed as rope sheaves, operates relatively free from friction.

In the embodiment of the invention illustrated in FIG. 1 the coupling means 10 is constructed as pawl means 20, the pawl 21 of which is provided with a large-area foot plate 22 by means of which the pawl 21 is pivotal and thereby frees the rope drive 12. The pawl 21 is spring biased in the closure direction.

To ensure reliable holding of the rope 13 in the blocking position of the pawl arrangement 20 the latter is designed to act on both runs 18 and 19 of the rope drive 12. For this purpose the pawl 21 is forked at its closure end and has two coupling arms 23, 24 which at their ends facing the rope 13 are provided with coupling faces explained in detail below. The arrangement is such that the coupling arms 23, 24 and the associated coupling faces are so shaped and aligned that independently of the direction when tensile forces act in the runs 18 and 19 the clamping force of at least one of the coupling arms 23 or 24 exerted on the rope drive 12 is increased.

The rail 7 with the guide pulleys 15 and 17 and the coupling means 10 form a compact unit which is incorporated into a corresponding shaped recess 25 in the top surface 2 of the surfboard 1 so that substantially only the foot plate 22 of the coupling means 10 projects beyond the top surface.

Since however in constructions of mast base arrangements having a slide secured in displaceable manner on the rail 7 on the surfboard for safety reasons separation of mast base and surfboard must be possible to avoid injury by clamping parts of the body between mast and top surface, as is explained in detail below with reference to FIG. 2 the mast base arrangement according to the invention is also designed such that the mast base lower part 34 (FIG. 2) and thus the entire rig can be separated from the slide in the manner of a safety binding.

For this purpose the slide 6 is provided at the upper side with an opening 35, said opening 35 being made continuous up to the rail 7 in the example of embodiment. The opening 35 has a diameter corresponding substantially to the diameter of the mast base lower part, said part 34 being engageable in the opening 35 of the slide 6. For this purpose the mast base lower part 34, which is constructed as short substantially cylindrical metal stud with rounded end, is provided with an annular groove 36. At a distance above the annular groove 36 the mast base lower part 34 comprises an annular flange 37 which rests on the upper side of the slide 6 when the mast base lower part 34 is completely inserted in the opening 35. The total weight of rig and mast base is therefore transmitted by the annular flange 37 to the slide 6 over a large area.

At a distance from the slide upper side corresponding to the distance between annular flange 37 and annular groove 36 two horizontal slots 38 are provided in the slide 6 and pass through the opening 35, being open towards the latter, and a spring member not illustrated can be inserted into said slots, the legs of said member engaging in the annular groove 36.

The mast base lower part 34 is rigidly connected to a large-area lever 59 in such a manner that when the mast base lower part is not in the opening by pivoting the lever 59 the mast base lower part can be pivoted with respect to the upper portion of the mast base or relatively to the rig. The lever 59 consists preferably of plastic and engages with a lower annular space 60 over the annular flange 37 of the mast base lower part. The connection between the lever 59 and mast base lower part can be effected according to an example of embodiment by force fit of the annular flange 37 in the annular space 60. According to another example of embodiment the connection between the lever 59 and mast base lower part 34 can be effected in that the lever 59 is tightened by means of a screw connection 61 against the mast base lower part 34, the screw connection 61 simultaneously establishing the connection to the universal joint. Advantageously, in this combination a disc 62 can be provided to ensure the rotatability of the lever 59 with respect to the mass base lower part 34.

Figure 2:
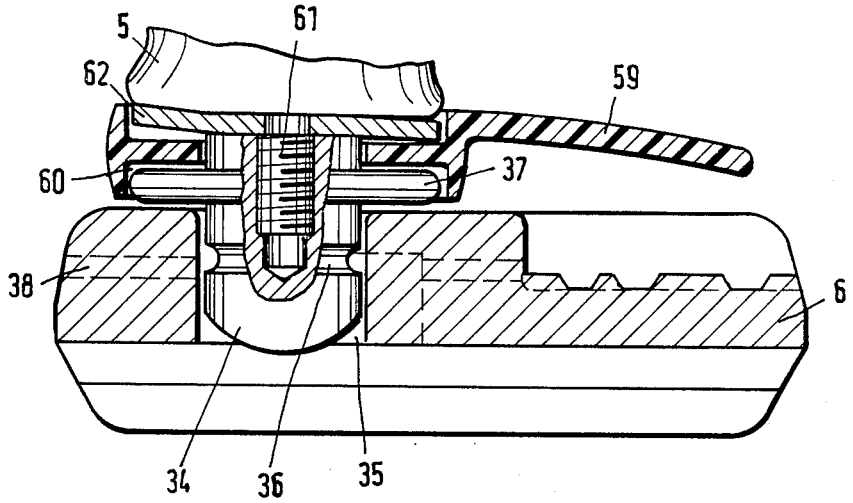
FIG. 2 is a longitudinal section through the slide, the mast base lower part, the lever and the lower part of the universal joint according to FIG. 1.

Whereas in FIG. 1 the lever 59 is shown transverse of the displacement direction of the slide, in the illustration of FIG. 2 it is shown pivoted parallel to the displacement direction of the slide. The lever is in the position illustrated substantially in FIG. 1 immediately after the insertion of the mast base lower part with the rig substantially adjacent the board, whereas afterwards, as illustrated by the arrow beneath the lever 59 in FIG. 1, the lever can be pivoted into its longitudinal position according to FIG. 2 which has the advantage that in this longitudinal position the lever is less obstructive and in said position simultaneously protects the components disposed below.

I claim:

1. An attachment means for connecting a mast to a surfboard comprising:

(a) a receiving means for receiving a mast;

(b) a resilient universal joint attached to said receiving means and aligned along the longitudinal axis of said receiving means;

(c) a mast base lower part attached to the end of said resilient universal joint opposite to said receiving means, having a projection along the longitudinal axis of said receiving means and said resilient universal joint and insertable into a receiving means attached to a surfboard; and (d) a handle attached to and projecting from said mast base lower part at an angle of substantially 90 degrees thereto, said handle having a length greater than the length of said mast base lower part, a width at the point of attachment greater than the diameter of said mast base lower part but less than the length of the handle, a substantially flat upper surface, and a spring constant substantially greater than the spring constant of said resilient universal joint said handle acting as a lever arm for bending the mast base lower part relative to the mast.

2. The attachment means according to claim 1 wherein the mast base lower part has an annular flange extending radially therefrom and said handle has an axially extending flange portion defining a lower annular space engaging over said annular flange.

3. The attachment means according to claim 2, wherein said engaging is by a force fit of said axially extending flange in said space.

4. The attachment means according to claim 2 wherein said universal joint is attached to said mast base lower part by a screw connection, said handle being clamping held between said universal joint and said annular flange of said mast base lower part.

5. The attachment means according to claim 4 further comprising a disc interposed between said universal joint and said handle.

6. The attachment means according to claim 5, wherein said handle has an upper annular space defined therein and said disc is positioned in said upper annular space.

7. The attachment means according to claim 1 wherein the handle is an extension of an annular ring arrayed circumferencially about and engaging said mast base lower part.

8. The attachment means according to claim 1 wherein the handle is disposed between the universal joint and the mast base lower part.

9. The handle according to claim 1 wherein the lever is formed from a synthetic resin.

10. The attachment means according to claim 1 wherein the universal joint is a unitary rubber member.

11. The attachment means according to claim 1 wherein the handle is an integal part of the mast base lower part.

12. The combination of surfboard, a mast with sail thereon, and an attachment means, said surfboard having a first receiving means in a top surface thereof, said attachment means comprising:

a second receiving means having a lower end of said mast fitted therein;

a resilient universal joint attached to said second receiving means and aligned along the longitudinal axis of said second receiving means;

a mast base lower part attached to said resilient universal joint having a relatively short projection along said longitudinal axis removably inserted into said first receiving means; and a handle attached to and projecting from said mast base lower part at an angle of substantially 90 degrees thereto, said handle having a length greater than the length of said mast base lower part, a width at the point of attachment greater than the diameter of said mast base lower part but less than the length of the handle, a substantially flat upper surface, and a spring constant substantially greater than the spring constant of said resilient universal joint said handle acting as a lever arm for bending the mast base lower part relative to the mast.

* * * * *

UNITED STATES PATENT AND TRADEMARK OFFICE

CERTIFICATE OF CORRECTION

PATENT NO. : 4,740,182

DATED : April 26, 1988

INVENTOR(S) : PERTRAMER

It is certified that error appears in the above-identified patent and that said Letters Patent is hereby corrected as shown below:

On the cover page, before "[21]", the following should read:

--[73] Assignee: Ernst Federle, Germering, Fed. Rep. of Germany--.

Signed and Sealed this

First Day of November, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,740,182

DATED : April 26, 1988

INVENTOR(S) : Siegfried PERTRAMER

It is certified that error appears in the above-identified patent and that said Letters Patent is hereby corrected as shown below:

Column 4, line 35, "clamping" should read --clampingly--.

Signed and Sealed this

Ninth Day of May, 1989

*Attest:*

DONALD J. QUIGG

*Attesting Officer*

*Commissioner of Patents and Trademarks*